United States Patent [19]

Hausmann et al.

[11] Patent Number: 4,610,292

[45] Date of Patent: Sep. 9, 1986

[54] INSULATING SHADE ASSEMBLY WITH REMOVABLE COVER

[75] Inventors: Scott Hausmann, West Brattleboro; Allan McLane, Jr., Marlboro, both of Vt.

[73] Assignee: Appropriate Technology Corporation, Brattleboro, Vt.

[21] Appl. No.: 734,290

[22] Filed: May 15, 1985

Related U.S. Application Data

[63] Continuation of Ser. No. 494,346, May 13, 1983, abandoned.

[51] Int. Cl.[4] ..... E06B 9/20

[52] U.S. Cl. ..... 160/120; 160/241; 160/270; 160/23 R

[58] Field of Search ..... 160/23 R, 120, 121, 160/241

[56] References Cited

U.S. PATENT DOCUMENTS

| | | | |
|---|---|---|---|
| 4,020,826 | 5/1977 | Mole | 160/DIG. 7 |
| 4,126,174 | 11/1978 | Moriarty et al. | 160/266 |
| 4,237,956 | 12/1980 | Sivin et al. | 160/241 |

FOREIGN PATENT DOCUMENTS

| | | | |
|---|---|---|---|
| 333567 | 8/1930 | United Kingdom | 160/120 |

*Primary Examiner*—Ramon S. Britts
*Assistant Examiner*—Cherney S. Lieberman
*Attorney, Agent, or Firm*—Wolf, Greenfield & Sacks

[57] ABSTRACT

An insulating window shade assembly includes a first roller carrying an insulating shade and a second roller carrying a cover fabric. The shade and cover fabric are supported in essentially face to face relationship, and their bottoms are secured together by a Velcro-type fastener. The cover fabric conceals the insulating shade, it may be removed from the shade for cleaning or may be changed and it may be adjusted for smoothness and to compensate for any stretching which occurs in the materials.

15 Claims, 7 Drawing Figures

INSULATING SHADE ASSEMBLY WITH REMOVABLE COVER

This application is a continuation of application Ser. No. 494,346, filed May 13, 1983, now abandoned.

This invention relates to insulating shades for windows and more particularly comprises a new and improved insulating shade with a removable cover fabric which enables the owner to change or clean the cover fabric as the owner wishes.

Conventional insulating shades are usually made up of a layer of insulating material and a separate cover fabric which are sewn, welded or otherwise adhered permanently together. Frequently, the shades are sold with the cover fabric attached, and the purchaser is offered only a limited selection of cover patterns. Other insulating shades are sold without the cover fabric, and the purchaser separately acquires the cover fabric and permanently secures it to the insulating layer.

Because the cover fabric in conventional prior art insulating shades is permanently secured to the insulating layer, the cover fabric cannot be changed or be cleaned independently of the insulating layer without very considerable expense and inconvenience to the owner. Moreover, the cover fabric cannot be adjusted for stretching of one layer with respect to the other nor for any wrinkles that may arise due to distortion of the insulation or fabric.

One important object of the present invention is to enable a person to remove the cover fabric from the insulating layer in an insulating window shade so that the cover fabric may be independently washed, cleaned or replaced.

Another important object of this invention is to provide a cover fabric which conceals the insulating layer and which may be adjusted to compensate for stretching or to smooth out any wrinkles that may appear.

In accordance with the present invention, the objectives are achieved by constructing the shade so that the cover fabric is not permanently attached to the insulating layer. This allows the cover fabric to be adjusted or be removed for cleaning or for replacement. And because the cover fabric is not permanently secured to the insulating material, the owner is allowed to use virtually any type of covering fabric. There are no constraints imposed by sewing, welding, or other attachment methods.

In accordance with the preferred form of this invention, the insulating window shade assembly includes a pair of spaced brackets that are adapted to be mounted on the opposite top sides of the frame of the window to be insulated. A roller with insulating material is mounted on the brackets, and the material is adapted to be drawn over the inside of the window. The roller for the insulating layer is operated by a pull cord counterwound on a pulley attached to the roller. A second roller carrying a cover fabric is mounted on the brackets and is disposed on the inside of the insulating layer when the insulating layer is drawn. The cover fabric is substantially the same width as the insulating material so as to cover the inside of the insulating layer when both sheets are drawn over the window. An idler roller is also mounted on the brackets inwardly of the insulating material, and the cover fabric extends about this roller. The idler roller supports the cover fabric very close to the insulating layer. The bottoms of the insulating layer and cover fabric are detachably secured together by a Velcro or similar type of fastener. The cover fabric roller is spring-loaded to retract the cover fabric, and the cover fabric is held in tension when the insulating sheet is drawn so that the cover sheet lies closely adjacent to and smoothly over the insulating layer. Channels on the sides of the window seal the edges of the insulating layer and overlap the side edges of the cover fabric to provide the shade with a finished appearance. A strip is carried on a batten at the bottom of the shade to seal against the window sill, and a second strip at the top of the insulating layer cooperates with the idler roller to push the insulating layer against the window trim to form a seal at the top of the window.

This invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 1:
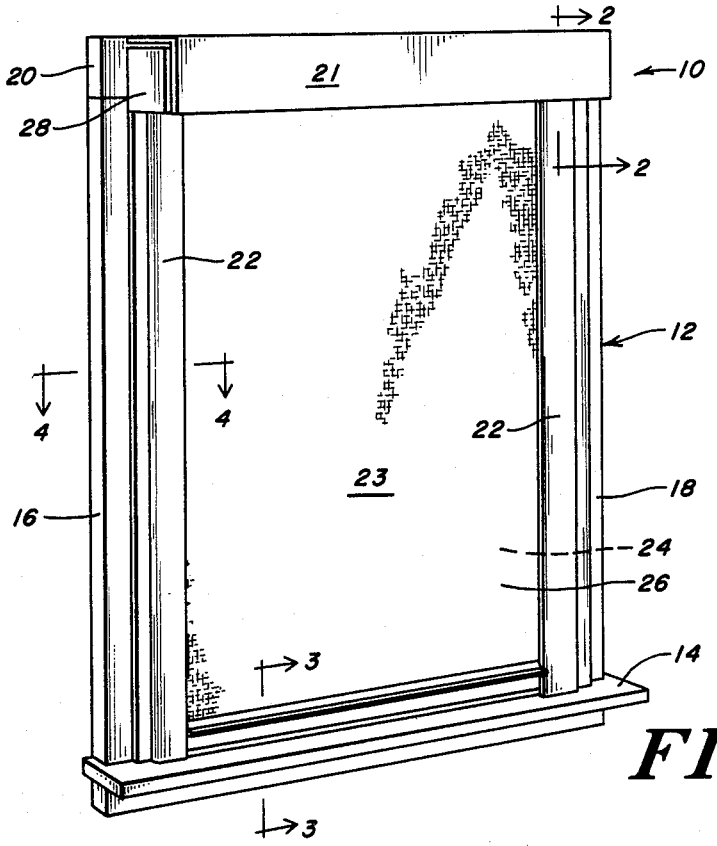
FIG. 1 is a front view of an insulating window shade assembly constructed in accordance with this invention, shown mounted on a window and in drawn position.

In FIG. 1 the shade assembly 10 is shown mounted on a window frame 12. The frame 12 includes a sill 14, left and right jambs 16 and 18, and a lintel 20. The window itself may be any variety; the window configuration per se is not part of the present invention.

The shade assembly 10 is mounted on the faces of the jambs 16 and 18 and lintel 20 and includes a valance 21, edge tracks 22, and shade 23 which has insulating layer 24 and cover fabric 26. The assembly also includes a pair of brackets 28, roller 30 for the insulating layer, cover fabric roller 32 and idler roller 34, all supported at the top of the window frame 12, and a batten 36 at the bottom of the shade. These several parts of the assembly along with their functions are described in detail below.

Figure 2:
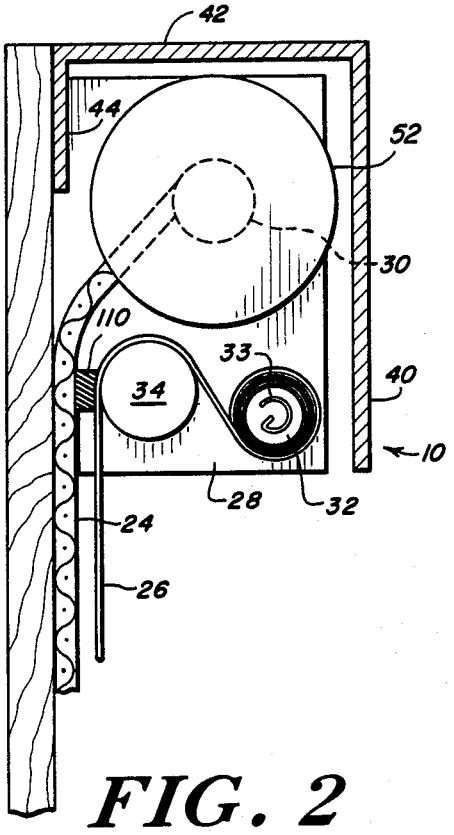
FIG. 2 is an enlarged fragmentary vertical cross-sectional view through the shade assembly and window, taken along section line 2—2 of FIG. 1.

The valance 21 shown in FIGS. 1 and 2 includes a front panel 40, a top wall 42 and a short rear wall 44. The rear wall 44 may be attached directly to the lintel 20 so as to fix the valance in place. It is to be understood that the configuration of valance shown is not critical to the present invention, and it may take a variety of different forms. One bracket 28 is mounted behind the front panel 40 of the valance 21 at each end of the valance, and the brackets 28 may be connected either to the valance itself or to the lintel 20. It is within the scope of this invention that the brackets 28 be connected directly to the window frame and the valance 21 be hung from the brackets.

Figure 5:
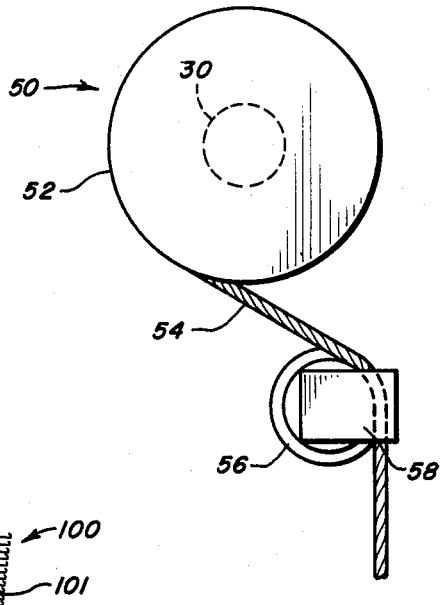
FIG. 5 is a detailed view of the pull cord subassembly of the invention.

Roller 30 which carries the insulating layer of material 24 is supported for rotation on the brackets 28 and is confined within the valance 21 behind front panel 40. Roller 30 may be of conventional construction and is operated by the pull cord system 50 shown in FIG. 5. The pull cord system includes a pulley 52 coaxial with and secured to one end of roller 30, and the roller and pulley rotate together. Pull cord 54 is wound on the pulley 52 in the counter direction of the insulating shade material 24 on roller 30 so that as the insulating material is drawn off roller 30, the pull cord 54 is wound onto pulley 52. Pull cord 54 extends about jamb roller 56 supported by yoke 58 on the jamb of the window so as to releasably lock the shade in any desired elevation.

The insulating shade material 24 may be made of a variety of different materials. In the preferred form, the material 24 is quilted and is made up of a multi-layered laminate including layers of polyester fabric, batting and polyester film. Normally, the insulating material is quite bulky and consequently requires substantially more space about the roller 30 to accommodate the material than is required for the cover fabric 26 wound about roller 32.

Figure 3:
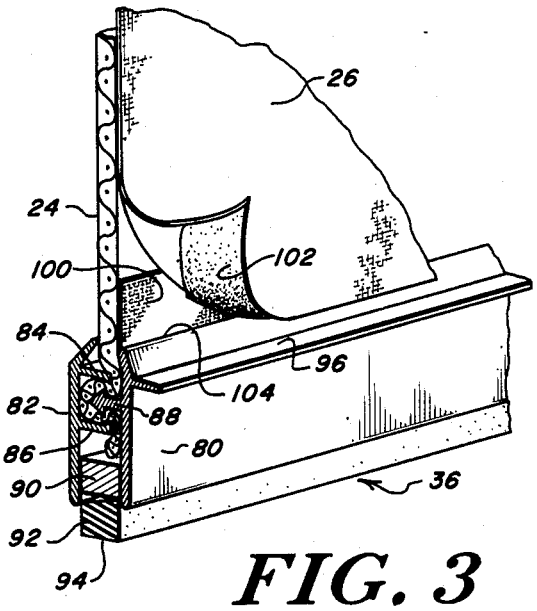
FIG. 3 is a fragmentary perspective view of the bottom of the shade assembly.

As shown in FIG. 2, cover fabric roller 32 is supported from brackets 28 below roller 30. Cover fabric 26 which may be made of any type of material and be of any weight is wound counterclockwise on roller 32 and extends from roller 32 over idler roller 34 and down the front of the window on the inside of insulating material 24. The insulating material 24 is wound clockwise about the roller 30, and it also extends behind the idler roller 34 on the window side of cover fabric 26. Roller 32 in the preferred form is biased as suggested by the mechanism 33 in FIG. 2 so as to constantly exert a tensioning pull on the cover fabric in an upward direction. This action of the roller 32 is counteracted by the connection between the cover fabric and the insulating material as shown in FIG. 3 and described in detail below.

Figure 4:
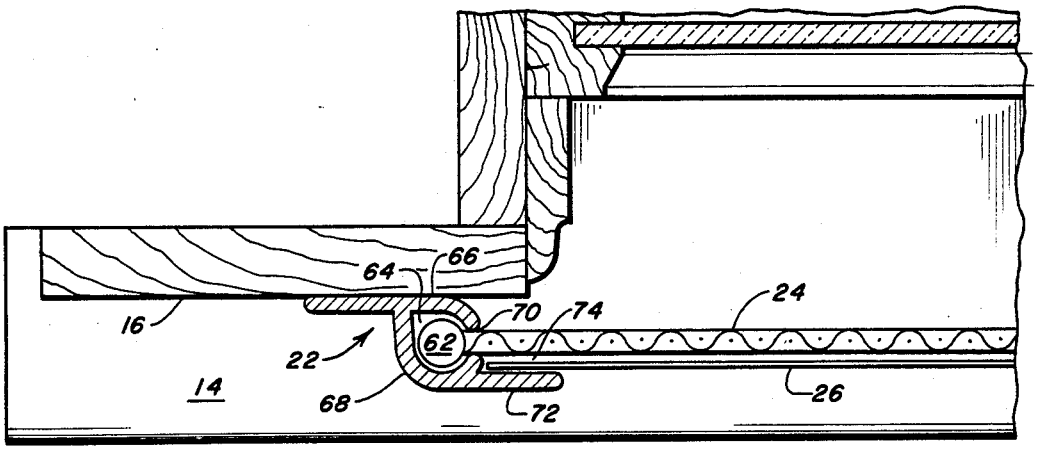
FIG. 4 is a horizontal cross-sectional view of the shade assembly and window, taken along section line 4—4 of FIG. 1.

The width of the cover fabric 26 is substantially the same as that of the insulating material 24 and it conceals the insulating material. The insulating material has a beaded edge 62 which is disposed in the channel 64 defined by legs 66 and 68 of the edge track 22. As shown in FIG. 4, bead 62 is disposed inside the channel 64, and its diameter is larger than the slot 70 defined by the inner edges of the legs 66 and 68. This arrangement forms a seal between the insulating material and the edge track so as to prevent cold air from flowing about the sides of the insulating material to the interior of the structure.

Edge tracks 22 on each window jamb include an inwardly extending flange 72 which overlaps the edge 74 of the cover fabric 26 so as to retain the side edges of the cover fabric closely adjacent the insulating material, prevent the edges from curling, conceal the insulating material 24 and otherwise provide the insulating shade with a finished appearance. As shown in FIG. 4, the edge track 22 is mounted on the front face of the jamb 16 forming part of the window trim.

Batten 36 at the bottom of the shade includes a front panel 80 and rear panel 82 with interfitting flanges 84, 86 and 88 which sandwich and encase the lower edge of the insulating material 24. The flange 88 is barbed to hold the parts together. A weight 90 is contained within the panels 80 and 82 of the batten so as to cause the shade to hang smoothly. Beneath the weight is a foam strip 92 that extends below the lower edges of the panels 80 and 82 and is intended to form a seal with the window sill 14 when the shade is fully drawn. The lower surface 94 of the foam strip 92 may be inclined slightly so as to conform to the inclination of the sill.

The inner panel 80 of the batten carries an inwardly extending flange 96 provided for the convenience of the operator. The flange 96 enables the operator to grasp the batten to draw the shade downwardly when the window is to be covered.

Figure 6:
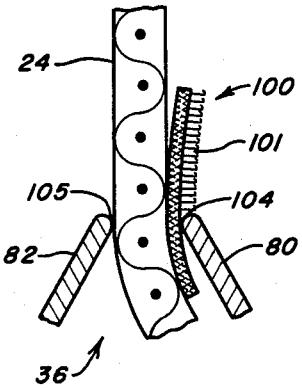
FIG. 6 is a cross-sectional detail view of the bottom of the shade assembly.
Figure 7:
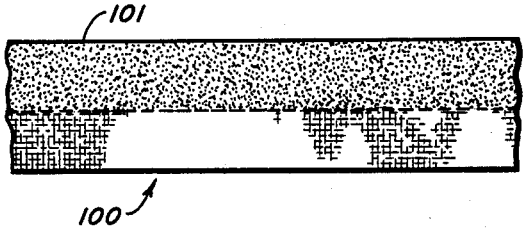
FIG. 7 is a plan view of a portion of the Velcro-type hook fabric used in the invention.

A strip 100 of hook-bearing Velcro-type material is provided at the bottom of the insulating material 24 and extends across the bottom of the shade. As shown in FIG. 7, the face of the strip 100 carries the hook members 101 on half the strip width while the other half is bare. The strip is not sewn or otherwise directly attached to the insulating material 24 but rather it is held in place by being clamped along with the bottom of the insulating material between the panels 80 and 82 of the batten 36. As is evident in FIG. 6, the part of the strip 100 which does not bear the hook members extends below the edges 104 and 105 of the panels 80 and 82 of the battens. Therefore, there are no hook members to interfere with the clamping of the strip.

It is very desirable that the strip 100 not be stitched or otherwise secured directly to the insulating material 24. When it is secured to that material, the strip tends to pull the bottom of the insulating material to one side with respect to the tracks 22, and this interferes with the seals between the track and the shade so as to lessen the effectiveness of the shade.

A complementary strip 102 of looped fabric is secured to the bottom of the cover fabric 26 so that the cover fabric may be secured at the bottom to the insulating material. The Velcro-type strips 100 and 102 face one another and therefore are not visible when the cover fabric is mounted in place over the insulating material. The cover fabric 26 should be just long enough to touch or slightly overlap the upper edge 104 of the inner panel 80 of the batten so as to give to the shade a finished appearance.

A second foam strip 110 is carried by the insulating material 24 at the top of the shade. The foam strip 110 is disposed on the side of the insulating material away from the window and is oriented so that it lies immediately behind the idler roller 34 when the shade is fully drawn. The foam strip 110 forces the insulating material against the window lintel 20 by virtue of its cooperation with the idler roller 34 so as to cause the insulating material to form a seal at the top against the window trim. The foam block also forms a seal between the insulating material and the cover fabric when the block is pinched behind the idler roller.

From the foregoing description of the shade, it is apparent that the cover fabric 26 may be removed from the shade assembly merely by opening the Velcro connection at the bottom of the shade above the batten 36 and winding the fabric onto the roller 32. The cover fabric and roller 32 may be dismounted from the brackets 28, and the cover may then be removed for any purpose and be readily changed if desired. This feature also enables the cover fabric and the insulating material to be cleaned separately, which is particularly desirable if the cover fabric and insulating material are different materials and therefore require different cleaning or washing processes. Of course the owner, if desired, may replace the cover fabric with another merely by removing the fabric from the roller 32 and loading the new fabric onto it. Thus, the owner is afforded complete flexibility.

It will also be apparent from the foregoing description that the cover fabric 26 with the valance 21 and tracks 22 conceals the insulating fabric. Furthermore, the bottoms of the cover fabric and insulating materials may be separated along the batten so that the cover fabric may be smoothed out if wrinkles or other distortions of the fabric occur for any reason. Consequently, the shade may always have a fresh, smooth look.

Because numerous modifications may be made of this invention without departing from its spirit, it is not intended to limit the scope of this invention to the single embodiment illustrated and described. Rather, it is intended that the scope of this invention be determined by the appended claims and their equivalents.

What is claimed is:

1. An insulating window shade assembly comprising:

a pair of spaced brackets adapted to be mounted on opposite top sides of the frame of a window to be insulated, a first roller carrying insulating material disposed within the brackets for enabling said insulating material to be drawn over the inside of said window, channels adapted to be mounted on the sides of the window for receiving the side edges of the insulating material to form a seal about its edges when the shade is drawn, a second roller disposed within the brackets and carrying a cover fabric for enabling the cover fabric to be drawn from the second roller on the inside of the window, said cover fabric being disposed on the inside of the insulating material when the insulating material and cover fabric are drawn, said cover fabric being substantially the same width as the insulating material to be capable of covering the inside of the insulating material when both are drawn over the window, a flange forming part of each of the channels for covering the side edges of the cover fabric when drawn over the window, a batten secured to the bottom edge of the insulating material, means detachably connecting the bottom edge of the cover fabric to the batten so that the insulating material and the cover fabric will move together when connected, the cover fabric being otherwise free of any direct connection with said insulating material so that the cover fabric may be detached from the batten to be removed or adjusted with respect to the insulating material, and an idler roller disposed within the brackets immediately inwardly of the insulating material and about which the cover fabric extends, said idler roller supporting the cover fabric when drawn, very closely adjacent the insulating material.

2. An insulating window shade assembly as defined in claim 1 further characterized by said second roller being biased to retract the cover fabric, and a pull cord connected to the first roller of insulating material for retracting it, the connection between the bottom edges of the fabric and insulating material enabling the position of the insulating material to control the position of the cover fabric.

3. An insulating window shade assembly as defined in claim 1 further characterized by an insulating strip connected at the top of the insulating material on the side thereof facing away from the window and adapted to lie squeezed between the idler roller and frame when the shade is drawn for sealing the insulating material against the top of the frame.

4. An insulating window shade assembly as defined in claim 3 further characterized by said insulating strip being a foam-like material and disposed between the insulating material and fabric when they are drawn.

5. An insulating window shade assembly as defined in claim 1 further characterized by a valance connected to the brackets and covering the rollers from the inside.

6. An insulating window shade assembly comprising:

bracket means adapted to be mounted on the frame of a window, a first roller carrying an insulating shade and being disposed within the bracket means on the inside of the window, said shade being adapted to be drawn from the roller to cover the inside of the window and to be wound upon the roller to expose the window, a second roller carrying a removable cover fabric on the inside of the shade and being supported by the bracket means, the second roller being spaced from and disposed independently of said first roller, means disposed adjacent only the bottom edge of the insulating shade for connecting only the bottom edge of said cover fabric to the bottom only of the insulating shade so that the insulating shade and cover fabric may be drawn together over the inside of the window, said connecting means being readily openable so that the cover fabric may be removed from or adjusted with respect to the insulating shade, the cover fabric being otherwise free of any direct connection with said insulating shade, guide means disposed adjacent the second roller and between the second roller and the insulating shade, said cover fabric passing over said guide means, for causing the cover fabric to hang closely adjacent the front of the insulating shade when the insulating shade is drawn over the window and when the insulating shade and cover fabric are connected together by said connecting means, and means for continually tensiðning the cover fabric when the insulating shade is drawn and when the cover fabric is connected thereto so that the cover fabric lies smoothly over the shade.

7. An insulating shade assembly as defined in claim 6 further characterized by:

a first strip of Velcro-type material fastened adjacent the bottom edge of the insulating shade, and a second strip of mating Velcro-type material fastened adjacent the bottom edge of the cover fabric, the second strip being in confronting relation with said first strip when the cover fabric is drawn so that the bottom edge of the cover fabric is disposed adjacent the bottom edge of the insulating shade, the two Velcro-type strips permitting the cover fabric to be removed from and adjusted with respect to the insulating shade.

8. An insulating shade assembly as defined in claim 7 further characterized by said first strip carrying hook members along a portion of its surface.

9. An insulating shade assembly as defined in claim 8 further characterized by clamping means engaging a portion of the first strip and the bottom of the insulated shade to hold them together, the portion of the first strip engaged by the clamping means being free of hook members on its surface.

10. An insulating window shade assembly as defined in claim 7 further characterized by sealing means carried by the shade adapted to be pushed against the window frame by the guide means when the shade is drawn to prevent the flow of air over the top of the first roller.

11. An insulating window shade assembly as defined in claim 7 further characterized by a pull cord connected to the first roller for rolling up the insulating material on said first roller to expose the window.

12. An insulating window shade assembly as defined in claim 7 wherein said tensioning means comprises biasing means connected to the second roller for tensioning the cover fabric on the shade.

13. An insulating window shade assembly as defined in claim 11 further characterized by a weight connected to the bottom of the shade to cause the shade to be drawn when the pull cord is released.

14. An insulating window shade assembly comprising:

a pair of spaced brackets adapted to be mounted on opposite top sides of the frame of a window to be insulated;

a first roller carrying insulating material disposed within the brackets for enabling said insulating material to be drawn over the inside of the window;

channels adapted to be mounted on the sides of the window for receiving the side edges of the insulating material to form a seal about its edges when the shade is drawn;

a second roller carrying a cover fabric and being disposed within the brackets, said cover fabric being adapted to be drawn from the second roller on the inside of the window, said cover fabric being disposed on the inside of the insulating material when the insulating material and cover fabric are drawn, said cover fabric being substantially the same width as the insulating material to be capable of covering the inside of the insulating material when both are drawn over the window; a flange forming part of each of the channels for covering the side edges of the cover fabric when drawn over the window;

a batten secured to the bottom edge of the insulating material;

means for detachably connecting the bottom edge of the cover fabric to the batten so that the insulating material and the cover fabric may move together when connected;

said insulating material and said cover fabric being otherwise unconnected and being detachable from one another by said connecting means, said cover fabric being removable from or adjustable with respect to the insulating material when detached therefrom at said connecting means;

an idler roller disposed within the brackets immediately inwardly of the insulating material and about which the cover fabric extends, the idler roller supporting the cover fabric when drawn very closely adjacent the insulating material;

means connected to the second roller for biasing the second roller in a direction for winding up the cover fabric onto the second roller;

a weight connected to the batten urging said insulating material downwardly off said first roller, the total weight of the insulating material, batten and weight being greater than the retracting force of said biasing means to prevent the biasing means from retracting said cover fabric when the insulating material is drawn and the insulating material and cover fabric are connected by said connecting means; and means connected to said first roller for winding up the insulating material onto said first roller.

15. An insulating window shade assembly comprising:

bracket means adapted to be mounted on the frame of a window;

a first roller carrying an insulating shade and being disposed within the bracket means on the inside of the window, said shade being adapted to be drawn from the roller to cover the inside of the window and to be wound upon the roller to expose the window;

a second roller carrying a removable cover fabric on the inside of the shade and being disposed within the bracket means, the second roller being disposed independently of the first roller;

a first strip of Velcro-type material, said first strip carrying hook members;

a second strip of Velcro-type material for mating with said first strip and being fastened adjacent the bottom edge of the cover fabric;

means clamping the first strip to the bottom edge of the insulating shade, a portion of the first strip engaged by said clamping means being free of hook members, said second strip being disposed adjacent to and in confronting relation with said first strip when said cover fabric is drawn so that the bottom edge of said cover fabric is closely adjacent the bottom edge of said insulating shade;

said insulating shade and said cover fabric being connected only at their bottom ends by mating of said first and second strips of Velcro-type material so that the insulating shade and cover fabric may be drawn together over the inside of the window, the cover fabric being removable from or adjustable with respect to the insulating shade by separating the first strip of Velcro-type material from the second strip of Velcro-type material;

guide means disposed adjacent the second roller and between the second roller and the insulating shade, said cover fabric passing over said guide means, causing the cover fabric to hang closely adjacent the front of the insulating shade when the insulating shade is drawn over the window and the insulating shade and cover fabric are connected together at their bottom edges; and means for continually placing the cover fabric in tension when the insulating shade is drawn and the cover fabric is connected to the insulating shade so that the cover fabric lies smoothly over the shade.

* * * * *